US008123329B2

(12) United States Patent
Yahiro

(10) Patent No.: US 8,123,329 B2
(45) Date of Patent: Feb. 28, 2012

(54) INKJET RECORDING APPARATUS AND METHOD

(75) Inventor: Yasuko Yahiro, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 765 days.

(21) Appl. No.: 12/057,225

(22) Filed: Mar. 27, 2008

(65) Prior Publication Data

US 2008/0238984 A1 Oct. 2, 2008

(30) Foreign Application Priority Data

Mar. 29, 2007 (JP) ..... 2007-089618

(51) Int. Cl.
*B41J 2/015* (2006.01)

(52) U.S. Cl. ..... 347/21; 347/28

(58) Field of Classification Search ..... 347/21, 347/28

See application file for complete search history.

(56) References Cited

U.S. PATENT DOCUMENTS

| | | | |
|---|---|---|---|
| 6,140,390 | A | 10/2000 | Bugner et al. |
| 6,155,666 | A | 12/2000 | Sugimoto et al. |
| 6,547,382 | B1 | 4/2003 | Shirota et al. |
| 6,648,464 | B1 | 11/2003 | Parazak |
| 2005/0200649 | A1 | 9/2005 | Yamaguchi et al. |
| 2006/0066661 | A1* | 3/2006 | Yamashita et al. ..... 347/21 |

FOREIGN PATENT DOCUMENTS

| | | | |
|---|---|---|---|
| EP | 0534634 | A1 | 9/1992 |
| JP | 64-63185 | A | 3/1989 |
| JP | 5-202328 | A | 8/1993 |
| JP | 8-281968 | A | 10/1996 |
| JP | 2000-85238 | A | 3/2000 |
| JP | 2003-54107 | A | 2/2003 |
| JP | 2003-34070 | A | 4/2003 |
| JP | 2003-171588 | A | 6/2003 |
| JP | 2004-98684 | A | 4/2004 |
| JP | 2004-115553 | A | 4/2004 |
| JP | 2006-66964 | A | 3/2005 |
| JP | 2005-254599 | A | 9/2005 |

OTHER PUBLICATIONS

Office Action dated Jun. 16, 2011 for corresponding Japanese Application No. 2007-089618.

* cited by examiner

*Primary Examiner* — Jerry Rahll

(74) *Attorney, Agent, or Firm* — Birch, Stewart, Kolasch & Birch, LLP

(57) ABSTRACT

The inkjet recording apparatus includes: a liquid set which includes a plurality of first liquids and a second liquid, the first liquids each containing solvent-insoluble materials, the second liquid causing the solvent-insoluble materials to form aggregate; a liquid ejection device which ejects the first liquids and the second liquid from different ejection ports; and a cleaning liquid supply device which supplies a cleaning liquid causing the aggregate of the solvent-insoluble materials to redispersed. The liquid set satisfies Dmax/Drain≦2.6, where Dmax is a maximum of average particle sizes of the solvent-insoluble materials in the first liquids, and Dmin is a minimum of the average particle sizes of the solvent-insoluble materials in the first liquids.

9 Claims, 7 Drawing Sheets

FIG.5

<INK SET 201>

| | INSOLUBLE MATERIAL | Dmax | Dmin | Dmax /Dmin | CLEANABILITY | | |
|---|---|---|---|---|---|---|---|
| | | | | | CLEANING LIQUID 1 | CLEANING LIQUID 2 | CLEANING LIQUID 3 |
| INK 101 | C. I. PIGMENT YELLOW 74 OF AVERAGE PARTICLE SIZE 151 nm | 151 | 52 | 2.9 | C | C | C |
| INK 102 | C. I. PIGMENT RED 122 OF AVERAGE PARTICLE SIZE 52 nm | | | | | | |
| INK 105 | C. I. PIGMENT BLUE 15:6 OF AVERAGE PARTICLE SIZE 76 nm | | | | | | |

<INK SET 202>

| | INSOLUBLE MATERIAL | Dmax | Dmin | Dmax /Dmin | CLEANABILITY | | |
|---|---|---|---|---|---|---|---|
| | | | | | CLEANING LIQUID 1 | CLEANING LIQUID 2 | CLEANING LIQUID 3 |
| INK 101 | C. I. PIGMENT YELLOW 74 OF AVERAGE PARTICLE SIZE 151 nm | 151 | 76 | 2.0 | A | A | A |
| INK 103 | C. I. PIGMENT RED 122 OF AVERAGE PARTICLE SIZE 85 nm | | | | | | |
| INK 105 | C. I. PIGMENT BLUE 15:6 OF AVERAGE PARTICLE SIZE 76 nm | | | | | | |

<INK SET 203>

| | INSOLUBLE MATERIAL | Dmax | Dmin | Dmax /Dmin | CLEANABILITY | | |
|---|---|---|---|---|---|---|---|
| | | | | | CLEANING LIQUID 1 | CLEANING LIQUID 2 | CLEANING LIQUID 3 |
| INK 101 | C. I. PIGMENT YELLOW 74 OF AVERAGE PARTICLE SIZE 151 nm | 151 | 76 | 2.0 | A | A | A |
| INK 104 | C. I. PIGMENT RED 122 OF AVERAGE PARTICLE SIZE 125 nm | | | | | | |
| INK 105 | C. I. PIGMENT BLUE 15:6 OF AVERAGE PARTICLE SIZE 76 nm | | | | | | |

<INK SET 204>

| | INSOLUBLE MATERIAL | Dmax | Dmin | Dmax /Dmin | CLEANABILITY | | |
|---|---|---|---|---|---|---|---|
| | | | | | CLEANING LIQUID 1 | CLEANING LIQUID 2 | CLEANING LIQUID 3 |
| INK 102 | C. I. PIGMENT RED 122 OF AVERAGE PARTICLE SIZE 52 nm | 125 | 52 | 2.4 | A | A | A |
| INK 103 | C. I. PIGMENT RED 122 OF AVERAGE PARTICLE SIZE 85 nm | | | | | | |
| INK 104 | C. I. PIGMENT RED 122 OF AVERAGE PARTICLE SIZE 125 nm | | | | | | |

FIG.6

<INK SET 205>

| | FIRST INSOLUBLE MATERIAL | SECOND INSOLUBLE MATERIAL | Dmax | Dmin | Dmax /Dmin | CLEANABILITY |
|---|---|---|---|---|---|---|
| INK 106 | C.I.PIGMENT YELLOW 74 OF AVERAGE PARTICLE SIZE 151 nm | ACRYLIC LATEX OF AVERAGE PARTICLE SIZE 30 nm | 151 | 30 | 5.0 | C |
| INK 107 | C.I.PIGMENT RED 122 OF AVERAGE PARTICLE SIZE 52 nm | ACRYLIC LATEX OF AVERAGE PARTICLE SIZE 30 nm | | | | |
| INK 110 | C.I.PIGMENT BLUE 15:6 OF AVERAGE PARTICLE SIZE 76 nm | ACRYLIC LATEX OF AVERAGE PARTICLE SIZE 30 nm | | | | |

<INK SET 206>

| | FIRST INSOLUBLE MATERIAL | SECOND INSOLUBLE MATERIAL | Dmax | Dmin | Dmax /Dmin | CLEANABILITY |
|---|---|---|---|---|---|---|
| INK 106 | C.I.PIGMENT YELLOW 74 OF AVERAGE PARTICLE SIZE 151 nm | ACRYLIC LATEX OF AVERAGE PARTICLE SIZE 30 nm | 151 | 30 | 5.0 | C |
| INK 108 | C.I.PIGMENT RED 122 OF AVERAGE PARTICLE SIZE 85 nm | ACRYLIC LATEX OF AVERAGE PARTICLE SIZE 30 nm | | | | |
| INK 110 | C.I.PIGMENT BLUE 15:6 OF AVERAGE PARTICLE SIZE 76 nm | ACRYLIC LATEX OF AVERAGE PARTICLE SIZE 30 nm | | | | |

<INK SET 207>

| | FIRST INSOLUBLE MATERIAL | SECOND INSOLUBLE MATERIAL | Dmax | Dmin | Dmax /Dmin | CLEANABILITY |
|---|---|---|---|---|---|---|
| INK 106 | C.I.PIGMENT YELLOW 74 OF AVERAGE PARTICLE SIZE 151 nm | ACRYLIC LATEX OF AVERAGE PARTICLE SIZE 30 nm | 151 | 30 | 5.0 | C |
| INK 109 | C.I.PIGMENT RED 122 OF AVERAGE PARTICLE SIZE 125 nm | ACRYLIC LATEX OF AVERAGE PARTICLE SIZE 30 nm | | | | |
| INK 110 | C.I.PIGMENT BLUE 15:6 OF AVERAGE PARTICLE SIZE 76 nm | ACRYLIC LATEX OF AVERAGE PARTICLE SIZE 30 nm | | | | |

<INK SET 208>

| | FIRST INSOLUBLE MATERIAL | SECOND INSOLUBLE MATERIAL | Dmax | Dmin | Dmax /Dmin | CLEANABILITY |
|---|---|---|---|---|---|---|
| INK 107 | C.I.PIGMENT RED 122 OF AVERAGE PARTICLE SIZE 52 nm | ACRYLIC LATEX OF AVERAGE PARTICLE SIZE 30 nm | 125 | 30 | 4.2 | C |
| INK 108 | C.I.PIGMENT RED 122 OF AVERAGE PARTICLE SIZE 85 nm | ACRYLIC LATEX OF AVERAGE PARTICLE SIZE 30 nm | | | | |
| INK 109 | C.I.PIGMENT RED 122 OF AVERAGE PARTICLE SIZE 125 nm | ACRYLIC LATEX OF AVERAGE PARTICLE SIZE 30 nm | | | | |

FIG.7

<INK SET 209>

| | FIRST INSOLUBLE MATERIAL | SECOND INSOLUBLE MATERIAL | Dmax | Dmin | Dmax /Dmin | CLEANABILITY |
|---|---|---|---|---|---|---|
| INK 111 | C. I. PIGMENT YELLOW 74 OF AVERAGE PARTICLE SIZE 151 nm | STYRENE ACRYLIC LATEX OF AVERAGE PARTICLE SIZE 57 nm | 151 | 57 | 2.6 | B |
| INK 112 | C. I. PIGMENT RED 122 OF AVERAGE PARTICLE SIZE 85 nm | STYRENE ACRYLIC LATEX OF AVERAGE PARTICLE SIZE 57 nm | | | | |
| INK 113 | C. I. PIGMENT BLUE 15:6 OF AVERAGE PARTICLE SIZE 76 nm | STYRENE ACRYLIC LATEX OF AVERAGE PARTICLE SIZE 57 nm | | | | |

<INK SET 210>

| | FIRST INSOLUBLE MATERIAL | SECOND INSOLUBLE MATERIAL | Dmax | Dmin | Dmax /Dmin | CLEANABILITY |
|---|---|---|---|---|---|---|
| INK 114 | C. I. PIGMENT YELLOW 74 OF AVERAGE PARTICLE SIZE 151 nm | STYRENE ACRYLIC LATEX OF AVERAGE PARTICLE SIZE 89 nm | 151 | 76 | 2.0 | A |
| INK 115 | C. I. PIGMENT RED 122 OF AVERAGE PARTICLE SIZE 85 nm | STYRENE ACRYLIC LATEX OF AVERAGE PARTICLE SIZE 89 nm | | | | |
| INK 116 | C. I. PIGMENT BLUE 15:6 OF AVERAGE PARTICLE SIZE 76 nm | STYRENE ACRYLIC LATEX OF AVERAGE PARTICLE SIZE 89 nm | | | | |

<INK SET 211>

| | FIRST INSOLUBLE MATERIAL | SECOND INSOLUBLE MATERIAL | Dmax | Dmin | Dmax /Dmin | CLEANABILITY |
|---|---|---|---|---|---|---|
| INK 117 | C. I. PIGMENT YELLOW 74 OF AVERAGE PARTICLE SIZE 151 nm | ETHYLENE ACRYLIC LATEX OF AVERAGE PARTICLE SIZE 8.7 nm | 151 | 8.7 | 17.4 | C |
| INK 118 | C. I. PIGMENT RED 122 OF AVERAGE PARTICLE SIZE 85 nm | ETHYLENE ACRYLIC LATEX OF AVERAGE PARTICLE SIZE 8.7 nm | | | | |
| INK 119 | C. I. PIGMENT BLUE 15:6 OF AVERAGE PARTICLE SIZE 76 nm | ETHYLENE ACRYLIC LATEX OF AVERAGE PARTICLE SIZE 8.7 nm | | | | |

INKJET RECORDING APPARATUS AND METHOD

BACKGROUND OF THE INVENTION

1. Field of the Invention

The present invention relates to an inkjet recording apparatus and an inkjet recording method, and more particularly, to an inkjet recording apparatus and an inkjet recording method using a reaction of two liquids, in which recording is performed by ejecting a first liquid which contains a solvent-insoluble material, and a second liquid which causes the solvent-insoluble material to aggregate, from respectively different ejection ports.

2. Description of the Related Art

There is a recording apparatus using an inkjet recording method (i.e., an inkjet recording apparatus), which performs recording by ejecting ink droplets to a recording medium from a plurality of nozzles (ejection ports), which are arranged on an ejection surface of a recording head. This kind of apparatus is used widely in both domestic and industrial applications, due to its low noise, low running costs, and the fact that it allows compact design. In a recording apparatus of this kind, if a recording medium having low water-resistance is used, such as normal paper, then color bleeding, feathering, density insufficiencies, and the like, are liable to occur, and a good image cannot be obtained, since it is not possible to set the density of the coloring material contained in the ink to a very high level, in order to achieve stable ejection over a long period of time.

One means for improving image quality in an inkjet recording apparatus is to use special paper (e.g., special inkjet paper) that has an ink absorbent layer. However, if special paper is used, then costs rise, placing a greater burden on the user, and since the thickness of the paper is increased in accordance with the thickness of the ink absorbent layer, then the aesthetic properties of the paper are also different to normal paper, and therefore special paper is not a desirable solution for all users.

There is an inkjet recording apparatus using a two-liquid reaction system, in which an ink and a treatment liquid are ejected from different ejection ports (nozzles), respectively. The ink contain& a coloring material, and the treatment liquid causes the coloring material to become insoluble or to aggregate By causing the ink and the treatment liquid to react with each other on the recording medium, the coloring material is insolubilized or caused to aggregate, thereby raising the fixing properties of the image, and satisfactory image quality that is free of color bleeding or feathering can be obtained. For example, Japanese Patent Application Publication No. 01-063185 discloses that a colorless ink (corresponding to a treatment liquid) that insolubilizes a dye is deposited onto a recording medium by a recording head. Japanese Patent Application Publication No. 05-202328 discloses that a polyvalent metal salt solution (corresponding to a treatment liquid) is first deposited on a recording medium, and then an ink containing a chemical dye having a carboxyl group is deposited thereon, in order to obtain images having good waterproofing characteristics and free of color bleeding. Japanese Patent Application Publication No. 2003-034070 discloses that an ink in which cationic resin micro-particles and organic pigment are combined and a recording characteristics enhancing liquid (corresponding to a treatment liquid) are used to achieve better lightfastness.

In the inkjet recording apparatus, ink contamination on the ejection surface of the recording head is a relatively common phenomenon. The ink contamination is caused by, for example: the adherence of satellite droplets of the ink, which are generated during ink ejection, to the ejection surface; the adherence of the ink to the ejection surface during maintenance operations, such as the nozzle suction or wiping; and the adherence of the ink on the recording medium to the ejection surface caused by the recording medium making contact with the ejection surface during conveyance. In a general inkjet recording apparatus other than the inkjet recording apparatus using the two-liquid reaction system, it is possible to remove the ink contamination on the ejection surface by carrying out preliminary ejection, nozzle suction, wiping, or the like; however, in the inkjet recording apparatus using the two-liquid reaction system, the ink contamination is a particularly serious problem. The treatment liquid is used with the object of making react with the ink on the recording medium, and if there is ink contamination on the ejection surface, then unwanted reaction occurs such that the openings of the nozzles become partially or completely blocked up by insolubilized or aggregated coloring material, which can readily lead to ejection defects, such as ejection failure.

Japanese Patent Application Publication No. 08-281968 discloses an inkjet printer having a plurality of wiping members and restricting the direction of wiping so as to prevent unwanted reaction, in order to ensure the reliability of the apparatus.

Furthermore, there is also technology which uses a set of a reactive ink and a cleaning agent that suppresses reaction of the ink, wherein a method for cleaning the recording head with the cleaning liquid is adopted and countermeasures are carried out once the recording head has ceased to be able to perform ejection due to the occurrence of unwanted reaction (see, for example, Japanese Patent Application Publication Nos. 2004-098684 and 2004-115553). Moreover, there is also technology in which a cleaning agent is applied to the ejection surface before ink ejection so that countermeasures are carried out proactively in order to prevent unwanted reaction of the ink (see, for example, Japanese Patent Application Publication No. 2005-254599).

On the other hand, there are also methods which improve the functionality of the ink by adding a resin component to the ink. A typical example for improving the functionality is a method in which a fixing resin is added to an ink, more specifically, an ink with added polymer latex is used, and when this ink is heated to a temperature equal to or greater than the glass transition temperature of the polymer latex after depositing this ink on the recording medium, the fixing properties and wear resistance of the image on the recording medium are improved, and furthermore, luster and a sense of transparency are imparted to the resulting Image (see, for example, Japanese Patent Application Publication Nos. 2000-085238 and 2003-171588).

However, in Japanese Patent Application Publication No. 08-281968, even if it is possible to prevent unwanted reaction to some extent, no countermeasures are provided in respect of reacted material that has already solidified. In particular, when using a pigment ink, aggregate of the pigment becomes fixed to the ejection surface due to the reaction with the treatment liquid, and it becomes impossible to restore the ejection surface to its original state, therefore leading, in the worst scenario, to a risk of serious damage to the recording head.

Moreover, in Japanese Patent Application Publication Nos. 2004-098684, 2004-115553 and 2005-254599, if the number of ink types is increased in order to improve color reproduction, then it is known that even if the same cleaning agent is used, a phenomenon of differing dispersion characteristics of the inks arises, and therefore a sufficient cleaning effect cannot be achieved.

Furthermore, in Japanese Patent Application Publication Nos. 2000-085238 and 2003-171588, although it is possible to achieve image recording which is free of bleeding, by using an ink containing resin additive, it is known that if the latex performs an unwanted reaction, then material that normally does not fuse unless heated to the glass transition temperature or above does fuse at a relatively low temperature, and the resin component becomes affixed solidly to the recording head, thus giving rise to ejection defects. Moreover, it is known that even if the recording head is cleaned by using the cleaning liquid in this state, the recording head cannot be restored and critical problems arise.

SUMMARY OF THE INVENTION

The present invention has been contrived in view of such circumstances, an object thereof being to provide an inkjet recording apparatus and an inkjet recording method based on a two-liquid reaction system, which are provided with a liquid set having improved redispersibility with respect to a cleaning liquid.

In order to attain the aforementioned object, the present invention is directed to an in et recording apparatus, comprising: a liquid set which includes a plurality of first liquids and a second liquid, the first liquids each containing solvent-insoluble materials, the second liquid causing the solvent-insoluble materials to form aggregate; a liquid ejection device which ejects the first liquids and the second liquid from different ejection ports; and a cleaning liquid supply device which supplies a cleaning liquid causing the aggregate of the solvent-insoluble materials to redisperse, wherein the liquid set satisfies $Dmax/Dmin \leqq 2.6$, where Dmax is a maximum of average particle sizes of the solvent-insoluble materials in the first liquids, and Dmin is a minimum of the average particle sizes of the solvent-insoluble materials in the first liquids.

According to this aspect of the present invention, by restricting the average particle sizes of the solvent-insoluble materials contained in the first liquids to a prescribed range, it is possible to provide the liquid set having improved redispersibility with respect to the cleaning liquid. Consequently, even if the solvent-insoluble material aggregates and solidifies on the surface of the liquid ejection device where the ejection ports are opened (the ejection surface), for example, it is still possible to return the device to its original state by cleaning by means of a cleaning device, and it is possible to achieve high-quality image recording which is free of ejection defects.

The present invention is not limited to the cleaning of the ejection surface of the liquid ejection device, and it can also be applied to the cleaning of a paper conveyance unit, or to the cleaning of the surface of a transfer body in an inkjet recording apparatus based on an intermediate transfer system, or the like.

In the present invention, by satisfying the relationship $Dmax/Dmin \leqq 2.6$, and more desirably, the relationship $Dmax/Dmin \leqq 2.0$, the cleaning properties with respect to the ejection surface of the liquid ejection device are improved.

Preferably, the average particle sizes of the solvent-insoluble materials in the first liquids are not smaller than 50 nm.

According to this aspect of the present invention, it is possible to prevent the formation of high-density aggregate.

Preferably, at least one of the first liquids contains at least one type of latex as the solvent-insoluble material.

According to this aspect of the present invention, the image fixing characteristics on the recording medium are improved.

Preferably, the at least one type of latex has a glass transition temperature not lower than 45° C.

According to this aspect of the present invention, it is possible to prevent fusion after aggregation.

Preferably, the inkjet recording apparatus further comprises a cleaning device which cleans a surface of the liquid ejection device by means of the cleaning liquid supplied from the cleaning liquid supply device, the ejection ports being opened in the surface.

The present invention is particularly suitable for the cleaning of the ejection surface of the liquid ejection device, and makes it possible to effectively prevent degradation of performance caused by the formation of unwanted aggregate.

In order to attain the aforementioned object, the present invention is also directed to an inkjet recording method, comprising: a liquid ejection step of ejecting a plurality of first liquids and a second liquid from different ejection ports of a liquid ejection device, the first liquids each containing solvent-insoluble materials, the second liquid causing the solvent-insoluble materials to form aggregate; and a cleaning liquid supply step of supplying a cleaning liquid causing the aggregate of the solvent-insoluble materials to redisperse, wherein the liquid set satisfies $Dmax/Dmin \leqq 2.6$, where Dmax is a maximum of average particle sizes of the solvent-insoluble materials in the first liquids, and Dmin is a minimum of the average particle sizes of the solvent-insoluble materials in the first liquids.

Preferably, the average particle sizes of the solvent-insoluble materials in the first liquids are not smaller than 50 nm.

Preferably, at least one of the first liquids contains at least one type of latex as the solvent-insoluble material.

Preferably, the at least one type of latex has a glass transition temperature not lower than 45° C.

Preferably, the inkjet recording method further comprises a cleaning step of cleaning a surface of the liquid ejection device by means of the cleaning liquid supplied in the cleaning liquid supply step, the ejection ports being opened in the surface.

According to the present invention, by restricting the average particle sizes of the solvent-insoluble materials contained in the first liquids to the prescribed range, it is possible to provide the liquid set having improved redispersibility with respect to the cleaning liquid. Consequently, even if the solvent-insoluble material aggregates and solidifies on the surface of the liquid ejection device where the ejection ports are opened (the ejection surface), for example, it is still possible to return the device to its original state by cleaning by means of the cleaning device, and it is possible to achieve high-quality image recording which is free of ejection defects.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 5 shows the cleaning properties evaluation results when using ink sets 201 to 204;

FIG. 6 shows the cleaning properties evaluation results when using ink sets 205 to 208; and FIG. 7 shows the cleaning properties evaluation results when using ink sets 209 to 211.

DESCRIPTION OF THE PREFERRED EMBODIMENTS

Description of Inkjet Recording Apparatus

An image forming apparatus according to an embodiment of the present invention is an inkjet recording apparatus of a serial type, which conveys a recording medium in a sub-scanning direction and moves a recording head reciprocally in a main scanning direction that is perpendicular to the sub-scanning direction or the direction of conveyance of the recording medium, in other words, in the breadthways direction of the recording medium, while ejecting liquid droplets respectively from a plurality of nozzles arranged on an ejection surface (nozzle surface) of the recording head. More particularly, the image forming apparatus is a recording apparatus based on a two liquid reaction system, in which colored inks containing coloring material (e.g., pigment) forming a solvert-insoluble material, and a treatment liquid which causes the coloring material to aggregate by reacting with the colored inks, are ejected separately and caused to mix together and react with each other on a recording medium. The inkjet recording apparatus according to the present embodiment in described in detail below.

Figure 1:
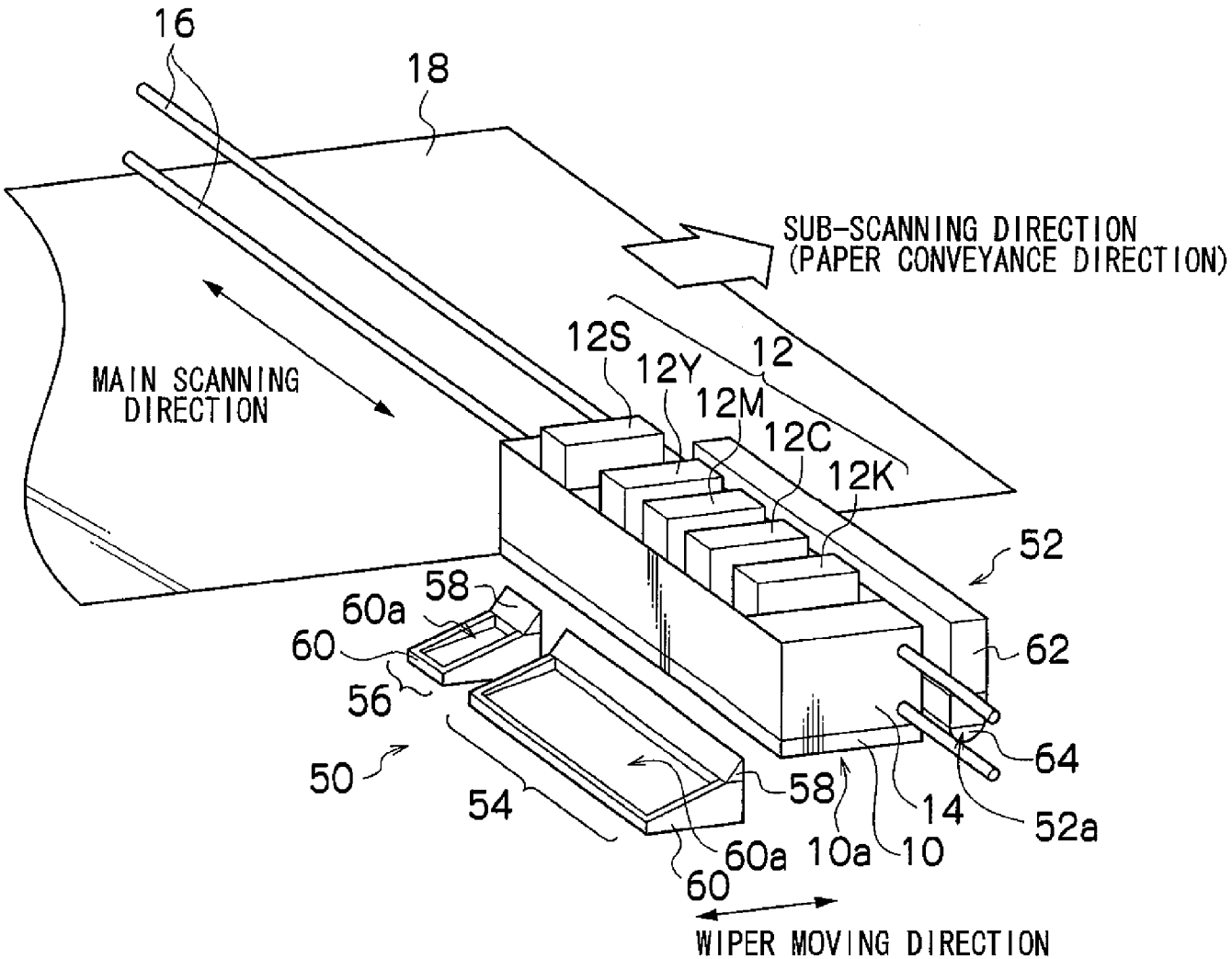
FIG. 1 is a general schematic drawing showing the general composition of an inkjet recording apparatus.

FIG. 1 is a general schematic drawing showing the general composition of an inkjet recording apparatus according to the present embodiment, which includes a recording head 10, cartridges 12 (12K, 12C, 12M, 12Y and 12S), a carriage 14 and a guide rail 16, for recording an image on a recording medium 18 (e.g., paper).

The recording head 10 is a liquid ejection device having a plurality of nozzles 30 (30K, 30C, 30M, 30Y and 305) (see FIG. 2) arranged on an ejection surface 10*a*, which faces the recording medium 18, and ejects droplets of prescribed liquids (colored inks and a treatment liquid) from the nozzles 30 toward the recording medium 18.

Each of the cartridges 12 is a liquid storage unit which forms a tank for storing the prescribed liquid, and is connected to a liquid flow channel formed inside the recording head 10. The liquid inside the cartridge 12 is supplied progressively to the recording head 10 as the liquid in the recording head 10 is consumed. In the present embodiment the cartridge system is used in which the cartridges can be replaced individually, whenever the remaining amount of liquid in each cartridge 12 has become low. Of course, it is also possible to adopt an ink tank system in which the ink is held in a main tank (not shown), and the liquid is replenished through a replenishment port (not shown).

The carriage 14 is capable of moving reciprocally in the main scanning direction along two guide rails 16, which extend in the breadthways direction of the recording medium 18 (i.e., in the main scanning direction). The recording head 10 and the cartridges 12 are mounted on the carriage 14 at prescribed positions. In the example shown in the drawings, the recording head 10 is attached to the lower surface of the carriage 14, and the five cartridges 12K, 12C, 12M, 12Y and 125, which correspond respectively to the colored inks of black (K), cyan (C), magenta (M) and yellow (Y) and the treatment liquid (S), are disposed over the recording head 10. Here, the serial scan type of recording system is adopted, in which the recording head is moved in the main scanning direction; however, it is also possible to adopt a single-pass recording system, in which recording is carried out by a fixed recording head.

In the inkjet recording apparatus, the prescribed liquids (the colored inks and the treatment liquid) are ejected toward the recording medium 18 from the nozzles 30 arranged on the ejection surface 10*a* of the recording head 10, while the recording medium 18 is conveyed in the sub-scanning direction (the paper conveyance direction) by a medium conveyance device (not shown) and the carriage 14 is moved reciprocally in the main scanning direction together with the recording head 10. On the recording medium 18, the colored inks mix and react with the treatment liquid, whereby the coloring material (pigment) contained in the inks aggregates, and therefore the fixing characteristics of the image are improved and image recording of high quality is achieved.

Figure 2:
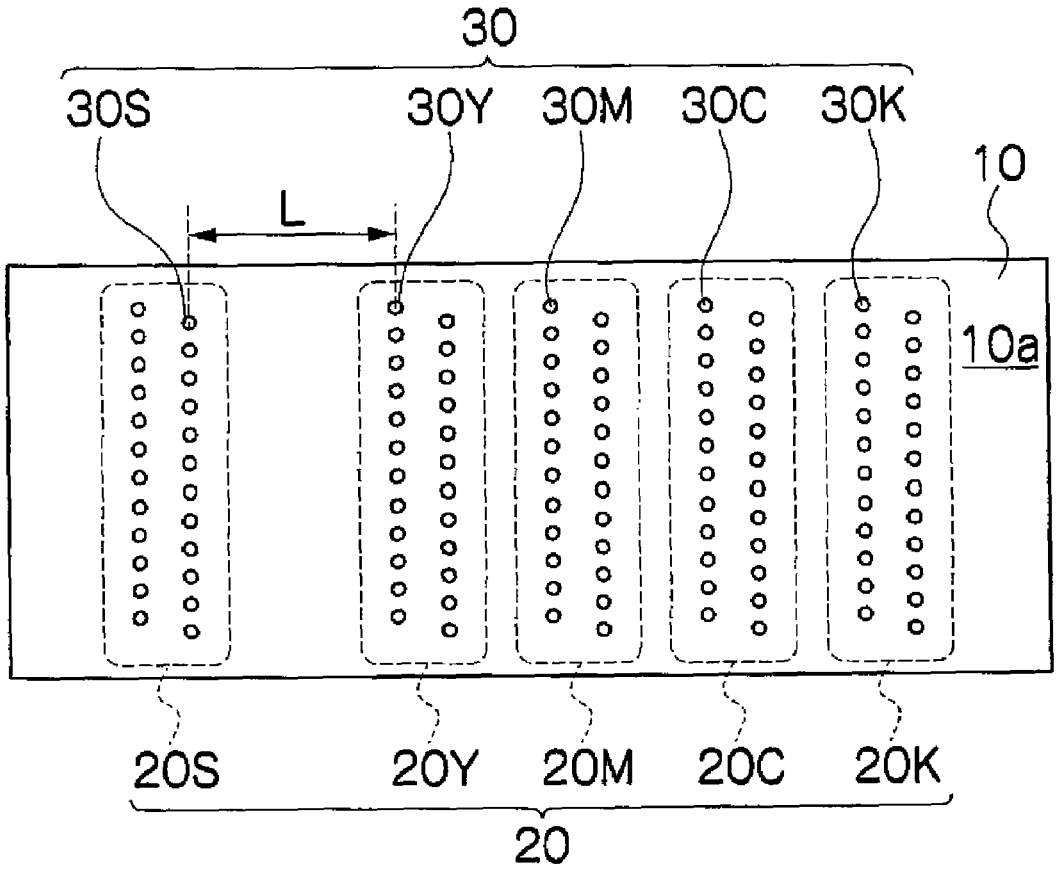
FIG. 2 is a plan diagram showing the ejection surface of a recording head.

FIG. 2 is a plan diagram showing the ejection surface 10*a* of the recording head 10. In FIG. 2, the ejection surface 10*a* of the recording head 10 has a plurality of nozzle regions 20 (20K, 20C, 20M, 20Y and 20S), which correspond respectively to the colored inks (K, C, M, Y) and the treatment liquid (S). The nozzles 30 (30K, 30C, 30M, 30Y and 30S), which respectively eject the corresponding colored inks and the treatment liquid, are arranged in a two-row staggered configuration in the respective nozzle regions 20. For example, the nozzles 30K in the nozzle region 20K eject the black ink and the nozzles 30S in the nozzle region 20S eject the treatment liquid.

It is desirable that the nozzle regions 20K, 20C, 20M and 20Y corresponding to the colored inks and the nozzle region 20S corresponding to the treatment liquid are arranged at the greatest possible distance apart. In other words, the minimum distance L between the ink ejection nozzles 30 (30K, 30C, 30M or 30Y) and the treatment liquid ejection nozzles 30S is made as large as possible. In the embodiment described below, the minimum distance L is set to 55 mm. Thus, it is possible to prevent the colored inks and the treatment liquid from mixing together on the ejection surface 10*a* of the recording head 10.

Figure 3:
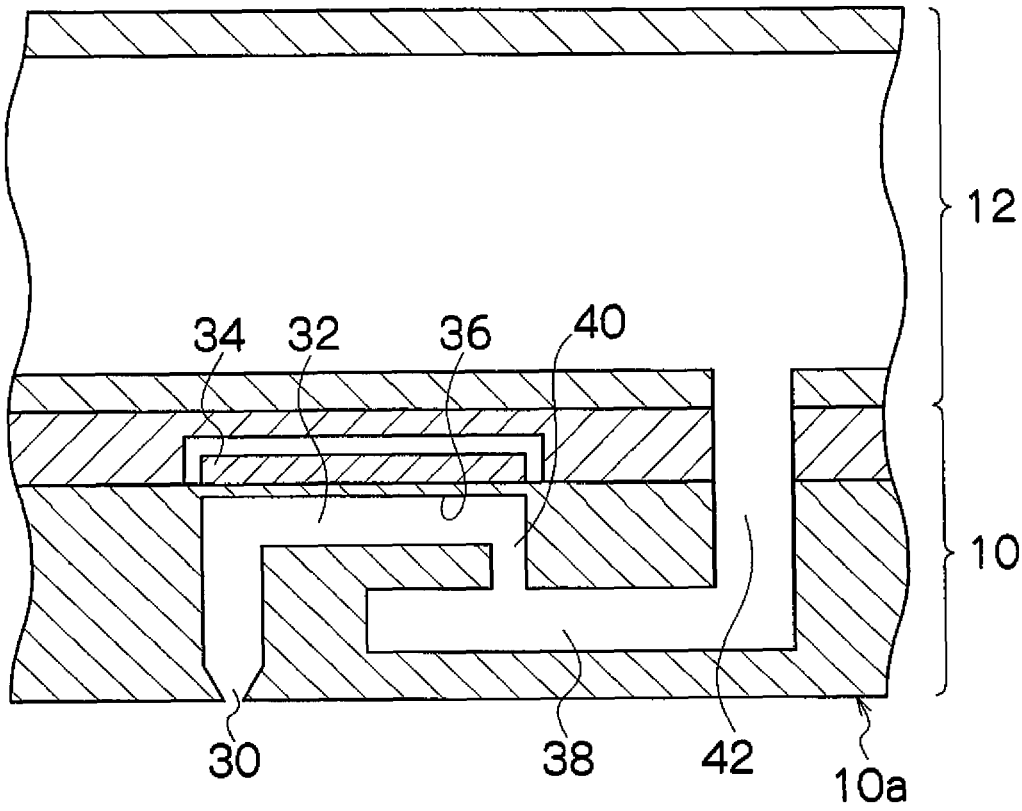
FIG. 3 is a partial cross-sectional diagram showing the principal composition of a recording head and a cartridge.

FIG. 3 is a partial cross-sectional diagram showing the principal composition of the recording head 10 and the cartridge 12. As shown in FIG. 3, a pressure chamber 32 is arranged at each nozzle 30 in the recording head 10. The pressure chamber 32 is a space which is filled with the prescribed liquid (one of the colored inks and the treatment liquid), and is connected to the nozzle 30. Furthermore, a piezoelectric element 34 is disposed at a position adjacent to the pressure chamber 32. The piezoelectric element 34 includes a thin film-shaped piezoelectric body and electrodes formed on upper and lower faces of the piezoelectric body, and is disposed on a diaphragm 36, which constitutes a wall of the pressure chamber 32 on the opposite side to the nozzle 30 (the upper surface of the pressure chamber 32 in FIG. 3), at the position corresponding to the pressure chamber 32 (in other words, at the position facing the pressure chamber 32 across the diaphragm 36).

A common flow channel 38 is a space which accumulates the prescribed liquid (one is of the colored inks and the treatment liquid) to be supplied to the pressure chambers 32, and is connected to each of the pressure chambers 32 through a supply port 40, which is formed at an end of each pressure chamber 32. Furthermore, the common flow channel 38 is connected to the cartridge 12, which is disposed above the recording head 10, through a supply flow channel 42.

In this composition, when a prescribed drive signal is applied to the piezoelectric element 34, the volume of the pressure chamber 32 is caused to change due to the deformation of the diaphragm 36 caused by the displacement of the piezoelectric element 34, and thereby the liquid inside the pressure chamber 32 is pressurized and a droplet of the liquid is ejected from the nozzle 30. After the liquid has been ejected, the liquid is refilled from the common flow channel 38 to the pressure chamber 32. Furthermore, the liquid inside the cartridge 12 is supplied progressively to the common flow channel 38 of the recording head 10, as the liquid is consumed by the recording head 10.

In the inkjet recording apparatus shown in FIG. 1, a wiping unit 50 (which is a cleaning device of the present invention) and a cleaning liquid supply unit 52 (which is a cleaning liquid supply device of the present invention) are arranged as a maintenance unit, in the vicinity of a maintenance position. The maintenance position is set outside a recording region, which is over the recording medium 18. If a nozzle blockage is detected by means of a detection device (not shown), or if it has become necessary to remove liquid (at least one of the colored inks and the treatment liquid) that has adhered to the ejection surface 10*a* of the recording head 10, for instance, after carrying out suction of the nozzles 30 by means of a nozzle suction device (not shown), then the carriage 14 is moved to the maintenance position as shown in FIG. 1, and a wiping operation is carried out on the ejection surface 10*a* of the recording head 10, by using the head wiping unit 50 and the cleaning liquid supply unit 52.

The head wiping unit 50 has an ink wiper 54 and a treatment liquid wiper 56. The ink wiper 54 is relatively long, and performs wiping of the nozzles regions 20K, 20C, 20M and 20Y corresponding to the colored inks on the ejection surface 10*a* of the recording head 10. The treatment liquid wiper 56 is relatively short, and performs wiping of the nozzle region 20S corresponding to the treatment liquid on the ejection surface 10*a*. In the embodiment shown in FIG. 1, one ink wiper 54 is provided in respect of the four nozzle regions 20K, 20C, 20M and 20Y; however, the present invention may also be applied to a case where a plurality of ink wipers 54 are provided.

The ink wiper 54 and the treatment liquid wiper 56 have a similar composition, apart from the fact that they are used to wipe different nozzle regions 20, and therefore the composition of the ink wiper 54 is described below as a representative example of these wipers.

The ink wiper 54 includes a projecting section 58 and a base section 60. The projecting section 58 has an edge projecting toward the recording head 10, and the base section 60 has a groove section 60*a*, which acts as a receptacle for the ink.

The projecting section 58 is made of an elastic material, and desirably, it is made of a material which has liquid repellent properties, so that the ink does not adhere thereto and solidify thereon, and which has ink resistant properties, so that it is not corroded by the ink. Possible examples of such a material include: fluoro rubber, silicone rubber, nitrile rubber, chloroprene rubber, ethylene propylene rubber, urethane rubber, and the like. Of these materials, fluoro rubber, which has especially strong liquid repellent properties, is most desirable. Moreover, the projecting section 58 is not limited to being a non-absorbent member of the above-described kind, and the present invention may also be applied to a case where the projecting section 58 is made of an absorbent member.

The bottom face of the groove section 60*a* in the base section 60 inclines toward the side opposite to the side adjacent to the projecting section 58, in such a manner that the ink in the groove section 60*a* accumulates readily at the side distant from the projecting section 58, and the ink in the groove section 60*a* is collected readily by means of a liquid collection tube (not shown).

The ink wiper 54 is movable in the wiper movement direction (see FIG. 1) by means of a drive device (not shown). The ink wiper 54 and the treatment liquid wiper 56 are movable in the wiper movement direction separately from each other.

The cleaning liquid supply unit 52 is constituted in the form of a replaceable cartridge, having a cleaning liquid tank 62 formed integrally thereon, and is disposed at a position that is aligned with the carriage 14 to the downstream side of the carriage 14 in the sub-scanning direction when the carriage 14 has moved to the maintenance position.

The cleaning liquid supply unit 52 has a supply port 52a opening on the lower side (the recording medium 18 side) thereof, and is provided with a roller 64, which almost closes off the supply port 52*a*. A prescribed cleaning liquid is stored in the cleaning liquid supply unit 52, and the cleaning liquid in the cleaning liquid supply unit 52 is supplied to a member that makes contact with the surface of the roller 64, as the roller 64 rotates.

Figure 4A:
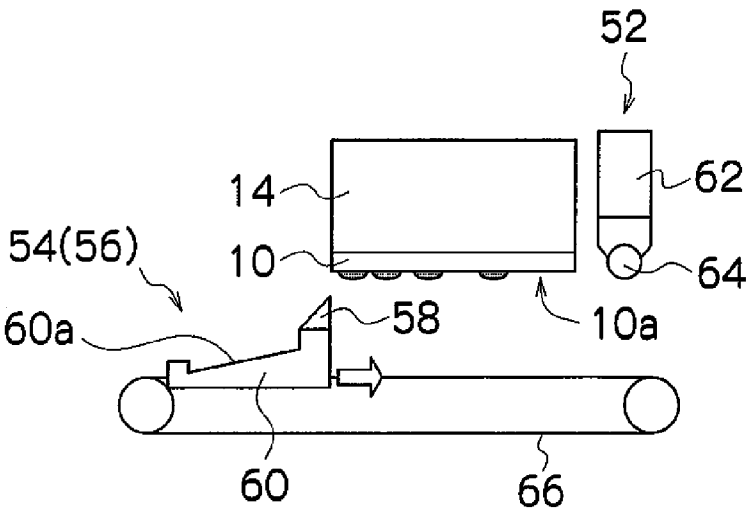
FIGS. 4A to 4D are illustrative diagrams showing the aspect of a wiping operation.
Figure 4B:
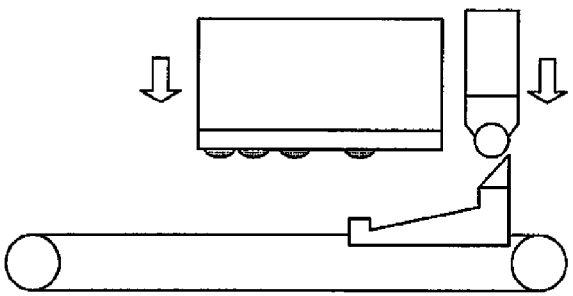

FIGS. 4A to 4D are illustrative diagrams showing an aspect of a wiping operation. FIG. 4A shows a state before the start of the wiping operation. When carrying out wiping of the ejection surface 10*a* of the recording head 10, firstly, the ink wiper 54 is slid to the side of the cleaning liquid supply unit 52, and the ink wiper 54 is halted immediately after the ink wiper 54 passes a position below the cleaning liquid supply unit 52, as shown in FIG. 4B. The drive device for moving the ink wiper 54 employs, for example, an endless belt 66 and a motor (not shown) such as that shown in the drawings, but of course it is not limited to this.

Subsequently, when the ink wiper 54 is in the halted state, the recording head 10 and the cleaning liquid supply unit 52 are lowered to a prescribed position. More specifically, the recording head 10 and the cleaning liquid supply unit 52 are lowered to the position so that, when the ink wiper 54 passes under the cleaning liquid supply unit 52 and the recording head 10 while the ink wiper 54 is slid toward its original position, the projecting section 58 of the ink wiper 54 makes contact with the cleaning liquid supply unit 52 and the recording head 10. In the embodiment shown in FIG. 4B, the position of the recording head 10 is lowered by altering the position of the carriage 14. It is also possible to raise the ink wiper 54 to a prescribed position, instead of lowering the recording head 10 and the cleaning liquid supply unit 52. The elevator devices for these may employ commonly known technology, and therefore description thereof is omitted here.

Figure 4C:
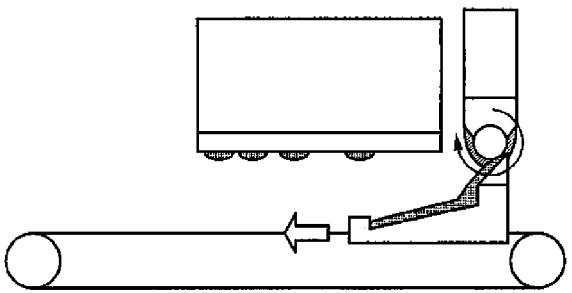
Figure 4D:
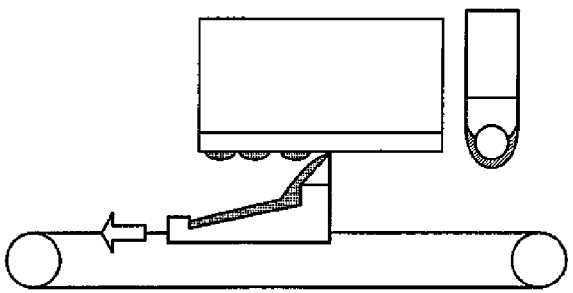

Thereupon, as shown in FIG. 4C, the ink wiper 54 is slid slowly toward its original position. In this case, firstly, when the projecting section 58 of the ink wiper 54 passes below the cleaning liquid supply unit 52, the roller 64 is turned due to being in contact with the projecting section 58, and the cleaning liquid in the cleaning liquid supply unit 52 is applied to the projecting section 58. Thereupon, when the projecting section 58 of the ink wiper 54 passes below the recording head 10, then as shown in FIG. 4D, the projecting section 58 of the ink wiper 54 is slid over the ejection surface 10*a* of the recording head 10 while wiping is thereby carried out, and the liquid (the colored ink or the treatment liquid) having adhered to the ejection surface 10*a* is thus wiped away. At this time, since the liquid surface 10*a* is cleaned by means of the cleaning liquid having been applied to the projecting section 58, then even if aggregated coloring material has been affixed to the ejection surface 10*a* due to reaction between the colored inks and the treatment liquid, then this aggregated material can be redispersed and removed by the cleaning liquid. The ink wiped away by the projecting 1s section 58 is collected into the groove section 60*a* in the base section 60 of the ink wiper 54. After the ink wiper 54 returns to its original position, the recording head 10 and the cleaning liquid supply unit 52 return to their original positions (heights).

Subsequently, similarly to the ink wiper 54, the treatment liquid wiper 56 is moved until passing the position below the cleaning liquid supply unit 52, whereupon the recording head 10 and the cleaning liquid supply unit 52 is lowered to the prescribed position, the treatment liquid wiper 56 is slid slowly toward the original position, and wiping is carried out by means of the projecting section 58 of the treatment liquid wiper 56 sliding over the ejection surface 10*a* of the recording head 10. Finally, when the treatment liquid wiper 56 has returned to its original position, the recording head 10 and the cleaning liquid supply unit 52 then return to their original positions (heights). In this way, the wiping operation carried out on the ejection surface 10*a* of the recording head 10 is completed.

In the present embodiment, the ink wiper 54 and the treatment liquid wiper 56 are not driven at the same timing, but rather are driven at different timings, and firstly, the inks adhering to the nozzle regions 20K, 20C, 20M and 20Y corresponding to the colored inks, on the ejection surface 10*a* of the recording head 10, is removed by the ink wiper 54, whereupon the treatment liquid adhering to the ejection surface 10*a* of the recording head 12 is removed by the treatment liquid wiper 56. The wipers 54 and 56 may be arranged so as to be independently drivable, or they may be arranged in such a manner that one wiper is driven in conjunction with the other wiper, at a prescribed time difference from same. It is also possible to first drive the treatment liquid wiper 56 and then drive the ink wiper 54.

In the present embodiment, it is possible to more effectively prevent mixing between the colored inks and the treatment liquid on the ejection surface 10*a* of the recording head 10, compared to a case where the ink wiper 54 and the treatment liquid wiper 56 are integrally formed, or a case where the ink wiper 54 and the treatment liquid wiper 56 are simultaneously driven. Moreover, even if the colored inks and the treatment liquid react together on the ejection surface 10*a* of the recording head 10 and a solid aggregate of the coloring material (pigment) becomes attached to the ejection surface 10*a*, then the aggregate is redispersed and removed by means of the cleaning liquid supplied through the cleaning liquid supply unit 52 during the wiping operation. Therefore, it is possible to achieve good image recording which is free of ejection defects.

The inkjet recording apparatus according to the present embodiment has been is described with reference to the serial type recording apparatus, which performs recording while moving the short recording head 10 reciprocally in the breadthways direction of the recording medium 18 (main scanning direction); however, the present invention may also be applied to a full line recording apparatus, which performs recording by means of scanning the recording medium 18 with a long line head corresponding to the width of the recording medium 18 just once in the paper conveyance direction of the recording medium 18 (sub-scanning direction).

Moreover, the recording head 10 according to the present embodiment uses the piezoelectric method whereby ejection is performed by using the displacement of the piezoelectric elements; however, the present invention can also be applied to other ejection methods. For example, it is possible to adopt a thermal method, which performs ejection by using the thermal energy generated by heating elements forming ejection elements, or an electrostatic method, which performs ejection by using electrostatic induction.

Furthermore, the configuration described in the present embodiment is provided with the colored inks of four standard colors, K, C, M and Y; however, the combinations of the colored inks and the number of colors are not limited to these, and light and/or dark inks can be added as required. For example, a configuration is possible in which recording heads for ejecting light-colored inks such as light cyan ink and light magenta ink are added.

Description of Inks

The colored inks (K, C, M, Y) used in the present embodiment are water-based pigment inks, which contain a pigment coloring material, and an acrylic latex, and the like, as solvent-insoluble materials.

It is desirable that the concentration of the solvent-insoluble materials in the ink is not less than 1 wt % and not more than 20 wt %, taking account of the fact that the viscosity of the ink suitable for ejection is 20 mPa·s or lower It is more desirable that the concentration of the pigment in the ink is not less than 4 wt %, in order to obtain good optical density in the image.

It is desirable that the surface tension of the ink is not less than 20 mN/m and not more than 40 mN/m, taking account of ejection stability.

It is possible that the ink contains polymer particles of one or various kinds in addition to the pigment and latex.

It is desirable in the present embodiment that the pigment contained in the composition of the aqueous pigment ink is an organic pigment. Below, specific examples of the organic pigment used in the composition of the aqueous pigment ink are given.

Examples of cyan pigments include: C. I. Pigment Blue 1, C. I. Pigment Blue 2, C. I. Pigment Blue 3, C. I. Pigment Blue 15, C. I. Pigment Blue 15:2, C. I. Pigment Blue 15:3, C. I. Pigment Blue 15:4, C. I. Pigment Blue 16, C. I. Pigment Blue 22, and the like, and the pigment is not limited to these.

Examples of magenta pigments include: C. I. Pigment Red 5, C. I. Pigment Red 7, C. I. Pigment Red 12, C. I. Pigment Red 48, C. I. Pigment Red 48:1, C. I. Pigment Red 57, C. I. Pigment Red 112, C. I. Pigment Red 122, C. I. Pigment Red 123, C. I. Pigment Red 146, C. I. Pigment Red 168, C. I. Pigment Red 184, C. I. Pigment Red 202, C. I. Pigment Red 207, and the like, and the pigment is not limited to these.

Examples of yellow pigments include: C. I. Pigment Yellow 12, C. I. Pigment Yellow 13, C. I. Pigment Yellow 14, C. I. Pigment Yellow 16, C. I. Pigment Yellow 17, C. I. Pigment Yellow 74, C. I. Pigment Yellow 83, C. I. Pigment Yellow 93, C. I. Pigment Yellow 95, C. I. Pigment Yellow 97, C. I. Pigment Yellow 98, C. I. Pigment Yellow 114, and the like, and the pigment is not limited to these.

The fixing resin contained in the ink may be an acrylic polymer, a urethane polymer, a polyester polymer, a vinyl polymer, a styrene polymer, or the like. In order to display sufficiently the functions of the material in improving fixing characteristics of the ink, it is necessary to add a polymer of relatively high molecular weight, at a high concentration (1 wt % through 20 wt %). However, if it is sought to add one of the aforementioned materials by dissolving in the liquid, then the liquid acquires a high viscosity and the ejection characteristics decline. In order to add a suitable material at a high concentration while suppressing increase in the viscosity, it is effective to add the material in the form of latex. Examples of the latex materials include: alkyl acrylate copolymer latex, carboxyl-modified SBR (styrene-butadiene rubber) latex, SIR (styrene-isoprene rubber) latex, MBR (methylmethacrylate-butadiene rubber) latex, NBR (acrylonitrile-butadiene rubber) latex, and the like. The glass transition temperature (Tg) of the latex has a significant effect during the fixing process, and it is desirably not lower than 50° C. and not higher than 120° C., in order to achieve both good stability during storage of the ink at normal temperature and good transfer characteristics after heating. Moreover, the minimum film forming temperature (MFT) of the latex also has a significant effect on fixing during the process, and it is desirably not higher than 100° C., and more desirably not higher than 50° C., in order to achieve suitable fixing at low temperatures.

Description of Cleaning Liquid

For the cleaning liquid, it is desirable to use a cleaning liquid containing a material that is included in the ink dispersion medium. It is more desirable to use the cleaning liquid containing the material that has the greatest concentration by weight in the ink dispersion medium. This is because the ink dispersion medium is designed so as to disperse the ink contents in particular. Consequently, if an aqueous ink is used, then suitable effects are obtained by using deionized water as the cleaning liquid. However, if the surface to be cleaned has fine undulations, then it is desirable to use a cleaning liquid containing a surfactant, in such a manner that that the cleaning liquid efficiently wets into the recesses on the surface. Examples of desirable surfactants include: anionic surfactants, such as fatty acid salt, alkyl sulfate ester salt, alkyl benzene sulfonic acid salt, alkyl naphthalene sulfonic acid salt, dialkyl sulfosuccinic acid salt, alkyl phosphoric acid ester salt, naphthalene sulfonic acid formalin condensate, polyoxyethylene alkyl sulfuric acid ester salt, and the like; and nonionic surfactants, such as polyoxyethylene alkyl ether, polyoxyethylene alkyl allyl ether, polyoxyethylene fatty acid ester, sorbitan fatty acid ester, polyoxyethylene sorbitan fatty acid ester, polyoxyethylene alkyl amine, glycerin fatty acid ester, oxyethylene oxypropylene block copolymer, and the like. Moreover, it is also desirable to use olefin. In order to achieve good long-term storage, it is desirable that the cleaning liquid contains a preservative, and more desirably, an organic solvent, such as glycerin, ethylene glycol, propylene glycol, diethylene glycol, polyethylene glycol, and the like.

EXAMPLES

The present invention is described in specific terms below with reference to practical examples, but the present invention is not limited to these examples.

Ink

In the examples, pigment inks of cyan (C), magenta (M), and yellow (Y) were used as the colored inks. Furthermore, pigment inks containing acrylic latex were used. Here, the details of the method of manufacturing the inks used in the examples are described.

Firstly, methods of dispersing the ink may use a ball mill, a sand mill, a beads mill, a high-pressure homogenizer, an ultrasonic homogenizer, and the like, and the method using the ultrasonic homogenizer is appropriate as the method that enables fine particles to be dispersed relatively easily. The ultrasonic homogenizer generates and collapses gas bubbles in the liquid by means of ultrasonic waves, and it is possible to pulverize the large particles in the liquid due to the impacts created by the cavitation effect. It is possible to adjust the average particle size and the content of large particles, by adjusting the irradiation time of the ultrasonic waves, or the irradiation energy of the ultrasonic waves, or both the irradiation time and energy of the ultrasonic waves. For the dispersant, an ABC type block polymer composed of methacrylic acid (A), benzyl methacrylate (B) and ethoxy triethylene glycol methacrylate (C) (A:B:C=13:4:10 (mol ratio)) was prepared. 30 g of the polymer, 9 g of 45% aqueous solution of potassium hydroxide, and 261 g of deionized water were mixed together until a uniform mixture was obtained. 150 g of C.I. Pigment Red 122 and 550 g of deionized water were added to the polymer mixture and mixed into same, and preliminary mixing was carried out by agitating for 30 minutes in a disperser machine. Next, this preparatory mixture was introduced into a dual tank with an internal capacity of 2 liters, and while agitating with a disperser blade and cooling by means of cooled water at 18° C., the mixture was subjected to batch irradiation for 30 minutes using an ultrasonic homogenizer US-1200T (manufactured by Nihon Seiki Seisakusho) with a 36-mm tip. In this operation, the amplitude of vibration was 28 μm and the energy density of the ultrasonic wave irradiation was 110 W/cm$^2$.

In the method described above, the irradiation time of the ultrasonic homogenizer was 30 minutes, and the ultrasonic irradiation energy density was 110 W/em$^2$, and moreover, five types of pigment dispersion having different particle size distributions were prepared, as inks 101 to 105, by varying the irradiation time and the irradiation energy.

Inks 106 to 119 were prepared as inks with added latex by adding to the pigment dispersion obtained by the method described above, an acrylic latex having average particle size of 30 nm in diameter (Jurymer ET-410 manufactured by Nihon Junyaku), styrene acrylic latexes having average particle sizes of 57 nm (Joncryl 537 manufactured by Johnson Polymer) and 89 nm (Joncryl 7640 manufactured by Johnson Polymer), and an ethylene acrylic latex having average particle size of 8.7 nm (Zailthene L, manufactured by Sumitomo Seika Chemicals), respectively, and then adding glycerin, diethylene glycol, Olfine E1010 (manufactured by Nisshin Chemical Industry), and deionized water, so as to achieve prescribed weight ratios, and mixing by agitation.

All of the pigments and latexes used in the inks were materials that produce an aggregating reaction when combined with the treatment liquid.

After the preparation, the inks were filtered through acetyl cellulose membrane filters having mean diameter of porous of 0.5 μm (manufactured by Fuji film) in order to remove large particles.

Ultimately, the inks 101 to 119 having the compositions indicated below were obtained:

Ink 101: pigment: C.I. Pigment Yellow 74 of average particle size 151 nm, 5 wt %;

Ink 102: pigment: C.I. Pigment Red 122 of average particle size 52 nm, 5 wt %;

Ink 103: pigment: C.I. Pigment Red 122 of average particle size 85 na, 5 wt %;

Ink 104: pigment: C.I. Pigment Red 122 of average particle size 125 nm, 5 wt %;

Ink 105: pigment: C.I. Pigment Blue 15:6 of average particle size 76 nm, 5 wt %;

Ink 106: pigment: C.I. Pigment Yellow 74 of average particle size 151 nm, 5 wt %,
latex: acrylic latex of average particle size 30 nm (Jurymer ET-410), 5 wt %;

Ink 107: pigment: C.I. Pigment Red 122 of average particle size 52 nm, 5 wt %,
latex: acrylic latex of average particle size 30 nm (Jurymer ET-410), 5 wt %;

Ink 108: pigment: C.I. Pigment Red 122 of average particle size 85 nm, 5 wt %,
latex: acrylic latex of average particle size 30 nm (Jurymer ET-410), 5 wt %;

Ink 109: pigment: C.I. Pigment Red 122 of average particle size 125 nm, 5 wt %,
latex: acrylic latex of average particle size 30 nm (Jurymer ET-410), 5 wt %;

Ink 110: pigment: C.I. Pigment Blue 15:6 of average particle size 76 nm, 5 wt %,
latex: acrylic latex of average particle size 30 nm (Jurymer ET-410), 5 wt %;

Ink 111: pigment: C.I. Pigment Yellow 74 of average particle size 151 nm, 5 wt %,
latex: styrene acrylic latex of average particle size 57 nm (Joncryl 537), 5 wt %;

Ink 112: pigment: C.I. Pigment Red 122 of average particle size 85 nm, 5 wt %,
latex: styrene acrylic latex of average particle size 57 nm (Joncryl 537), 5 wt %;

Ink 113: pigment: C.I. Pigment Blue 15:6 of average particle size 76 nm, 5 wt %,
latex: strene acrylic latex of average particle size 57 nm (Joncryl 537), 5 wt %;

Ink 114: pigment: C.I. Pigment Yellow 74 of average particle size 151 nm, 5 wt %,
latex: styrene acrylic latex of average particle size 89 nm (Joncryl 7640), 5 wt %;

Ink 115: pigment: C.I. Pigment Red 122 of average particle size 85 nm, 5 wt %,
latex: styrene acrylic latex of average particle size 89 nm (Joncryl 7640), 5 wt %;

Ink 116: pigment: C.I. Pigment Blue 15:6 of average particle size 76 nm, 5 wt %,
latex: styrene acrylic latex of average particle size 89 nm (Joncryl 7640), 5 wt %;

Ink 117: pigment: C.I. Pigment Yellow 74 of average particle size 151 nm, 5 wt %,
latex: ethylene acrylic latex of average particle size 8.7 nm (Zaikthene L), 5 wt %;

Ink 118; pigment: C.I. Pigment Red 122 of average particle size 85 nm, 5 wt %,
latex: ethylene acrylic latex of average particle size 8.7 nm (Zaikthene L), 5 wt %;

Ink 119: pigment: C.I. Pigment Blue 15:6 of average particle size 76 nm, 5 wt %,
latex: ethylene acrylic latex of average particle size 8.7 nm (Zaikthene L), 5 wt %.

In each of the inks 101 to 109, the compositions other than the pigment and the latex were as follows:
glycerin, 20 wt %;
diethylene glycol, 10 wt %;
Olfine E1010, 2 wt %; and
deionized water, remainder.

Treatment Liquid

A treatment liquid having the following composition was used in the examples:
deionized water, 69 wt %;
glycerin, 20 wt %;
diethylene glycol, 10 wt %;
Olfine E1010, 1 wt %; and
pH adjuster, trace.

Measurement of Particle Size

The particle size was measured with a particle size distribution analyzer (Nanotrac UPA-EX150 manufactured by Nikiso). This particle size distribution analyzer uses a measurement principle known as "dynamic light scattering". If the particles have diameters of several micrometers or smaller, then a Brownian motion of the particles is produced, due to the effects of the movement of the solvent molecules. The speed of this motion varies with the size of the particles: the smaller the particles, the faster they move, and the larger the particles, the slower they move. When laser light is irradiated onto these particles in motion, scattering of light of different phases occurs in accordance with the speed of the particles, and when the scattered light is spectrally analyzed, a Doppler shift is obtained. In this way, the dynamic light scattering method determines the particle size distribution by calculating the Doppler-shifted particle size information. In the measurement of particle size distribution of the insoluble material of the ink, in all cases, the ink was diluted 1000 times by weight in deionized water, and the measurement was carried out in transparent mode, for a nonspherical shape.

Cleaning Liquid

The most simple option is to use the dispersion medium of the ink as the cleaning liquid. The progress of the reaction in the mixture of the ink and the treatment liquid can be suppressed by diluting the mixture with the ink dispersion medium. In the examples, the ink dispersion medium was used as the cleaning liquid. Furthermore, a cleaning liquid having low surface tension, and deionized water as a simple cleaning liquid were prepared.

The cleaning liquids having the following compositions were used in the examples:

Cleaning Liquid 1:
glycerin, 20 wt %,
diethylene glycol, 10 wt %,
Olfine E1010, 2 wt %, and
deionized water, remainder;

Cleaning Liquid 2:
glycerin, 30 wt %,
Olfine E1010, 10 wt %, and
deionized water, remainder; and Cleaning Liquid 3:
deionized water, 100%.

Evaluation Method

Evaluation experiments were carried out using the inkjet recording apparatus shown in FIG. 1 and the plurality of ink sets 201 to 211 described below.

An ejection head, PX-G930 (manufactured by Seiko Epson), of a piezoelectric type was used as the recording head 10. Furthermore, cartridges 12 corresponding to the inks of each ink set were mounted in the carriage 14. In the examples, each of the ink sets 201 to 211 was made up of three of the inks, and the three cartridges 12 corresponding to these inks were mounted on the carriage 14 to carry out the evaluation experiments.

Firstly, a drive signal was applied to the recording head 10 so that it was confirmed that each of the 180 nozzles 30 of the nozzle region 20 corresponding to each colored ink was performing ejection normally, under ejection conditions where each of the droplets ejected from the nozzles 30 had a volume of 1.5 picoliters (pl).

Thereupon, a sheet of PET polyethyleneterephthalate) coated with a 3 μm thick layer of the treatment liquid was pressed against the ejection surface 10*a* of the recording head 10 for approximately one second. This was an artificial reproduction of a state where the recording medium 18 on which the treatment liquid had been deposited came into contact with the ejection surface 10*a*. Thereby, the ink and the treatment liquid reacted with each other in the vicinity of the openings of the nozzles 30, and the aggregation reaction of the coloring material (pigment) contained in the ink proceeded.

Next, the wiping operation was carried out once on the ejection surface 10*a* of the recording head 10, by using each of the above-described cleaning liquids. A fluoro rubber having particularly strong liquid repellent properties was used for the projecting section 58 of the wipers 54 and 56. Finally, the ejection status of the 180 nozzles 30 was confirmed by printing a nozzle check pattern. If the ejection was performed from all of the nozzles, then this indicated that the cleaning had been carried out satisfactorily and continuous ejection was possible, meaning that the head could be installed in an apparatus without any problem. If, on the other hand, the ratio of nozzles not performing ejection was smaller than 10%, then although the nozzles suffering ejection failure would not be restored even if the nozzle cleaning operations were carried out a further 20 times or 30 times, yet it was confirmed that if, in this state, the ink inside the recording head 10 was temporarily removed, the cleaning liquid was supplied to the recording head from the ink supply side, a maintenance unit was positioned by the nozzles, and a suctioning operation was then carried out, then all of the nozzles were restored to an ejectable state. On the other hand, if the ratio of nozzles suffering ejection failure was 10% or larger, then full restoration to an ejectable state was not possible, even if the suctioning operation was carried out. If the ratio of nozzles suffering ejection failure was not smaller than 10%, then cleaning was not possible and the head could not be installed in an apparatus in this state.

The cleaning properties of the cleaning liquids with respect to the ejection surface 10*a* of the recording head 10 were evaluated as follows: a case where all of the nozzles 30 performed ejected was evaluated as "A", a case where there were some nozzles 30 that did not perform ejection but these were less than 10% was evaluated as "B", and a case where the nozzles 30 that did not perform ejection were not less than 10% was evaluated as "C".

Evaluation Results

Firstly, FIG. 5 shows the cleaning properties evaluation results in a case where the pigment ink sets 201 to 204 were used in combination with the cleaning liquid 1, the cleaning liquid 2 and the cleaning liquid 3. FIG. 5 shows the evaluation results for cleaning properties in the case where the ink sets 201 to 204 were used, as well as the maximum particle size Dmax and the minimum particle size Dmin of the solvent-insoluble materials contained in the inks of each ink set, and the ratio between these particle sizes, Dmax/Dmin.

The results in FIG. 5 revealed that, if Dmax/Dmin was equal to or less than 2.4, then the cleaning properties with respect to the ejection surface 10*a* were satisfactory. In particular, it was seen that when Dmax/Dmin was equal to or smaller than 2.0, then even more satisfactory cleaning properties on the ejection surface 10*a* were obtained.

Next, FIG. 6 shows the cleaning properties evaluation results for a case where the cleaning liquid 1 was used in combination with the ink sets 205 to 208 of the pigment inks containing the latex. The results in FIG. 6 revealed that, if the average particle size of the acrylic latex was 30 μm, then in all cases, the cleaning properties evaluation result was "C", and thus it was seen that in this case satisfactory cleaning properties were not obtained. This shows that, if the particle size ratio is large, then small particles become embedded in between the large particles, a high-density aggregate is formed, and therefore the redispersibility with respect to the cleaning liquid is reduced. In the ink set having the large particle size ratio, satisfactory redispersion by the cleaning liquid can not be obtained.

Then, the cleaning properties were evaluated for a case where the cleaning liquid 1 was used in combination with the ink sets 209 to 211 of the pigment inks containing other latexes, of which the results are shown in FIG. 7. The results in FIG. 7 revealed that, if Dmax/Dmin was equal to or less than 2.6, then the cleaning properties with respect to the ejection surface 10*a* were satisfactory. In particular, it was seen that when Dmax/Dmin was equal to or less than 2.0, then even more satisfactory cleaning properties on the ejection surface 10*a* were obtained.

From the above-described evaluation results, it was seen that the average particle size ratio of the solvent-insoluble materials, such as the pigments and the latexes, related to the cleaning properties, regardless of the latex materials used. More specifically, by using the ink set in which Dmax/Dmin is not more than 2.6, and desirably not more than 2.0, then the cleaning properties with respect to the ejection surface 10*a* of the recording head 10 are satisfactory, and even if the colored inks and the treatment liquid produce a solidified aggregate of the coloring material (pigment) by reacting with each other on the ejection surface 10*a*, then it is still possible to restore the head satisfactorily to its original state, by cleaning the ejection surface 10*a* by means of the wiping operation that uses the cleaning liquid. Therefore, it is not necessary to carry out a further restoration operation, such as nozzle suction or preliminary ejection, and it is possible to achieve satisfactory image recording, which is free of ejection defects.

It is considered that the reason why the particle size ratio of the solvent-insoluble materials is related to the cleaning properties is due to the density of the aggregate and the strength of the aggregating force. If a structure is produced in which the particles of large size are mutually adjacent, then it can be deduced geometrically that the particle size ratio of 2.6 or smaller is necessary, as a condition whereby the small particles are disposed so as to be embedded in the gaps between the large particles.

Moreover, it can be understood analytically that, as the particle size ratio becomes larger, the frequency of collision between the particles increases, and the aggregating reaction becomes fasten As the particle size ratio becomes larger, so the speed of aggregation increases, the probability of forming a high-density aggregate rises, and ultimately a hard aggregate is formed, meaning that the aggregate cannot be easily redispersed.

The relationship between the particle size ratio and the volume of the aggregate was investigated. The inks in the ink sets were mixed in equal quantities, and droplets of the mixed ink were deposited by the above-described inkjet recording apparatus onto a non-permeable medium on which the treatment liquid had been applied. Each of the droplets had a volume of 7 pl. The aggregate obtained by this printing process was cleaned with water so as to remove the high-boiling-point solvent. The resulting structure of the aggregate was examined through an electron microscope, and it was seen that the gaps in the aggregate were relatively small in the case of the ink set 201, where Dmax/Dmin was 2.9, meanwhile the gaps in the aggregate were relatively large in the case of the ink sets 202, 203, 204, 209 and 210, where Dmax/Dmin was 2.6, 2.4 or 2.0, which showed satisfactory redispersibility of the cleaning liquid.

Furthermore, the volume of the aggregate was measured through a laser microscope (model VK-9500, manufactured by Keyence). In the case of the ink sets 202, 203, 204, 209 and 210 having a Dmax/Dmin ratio of 2.6, 2.4 or 2.0, the volume of the dot formed of each droplet of 7 pl on a non-permeable PET medium was 3000 $\mu m^3$. On the other hand, in the case of the ink sets 205, 206, 207 and 208, the volume of the dot formed from each droplet of 7 pl on a non-permeable PET medium was decreased to 1500 $\mu m^3$, thus indicating the formation of high-density aggregate.

As described above, if the density of the aggregate is low and a high-density aggregate is formed, then the contact surface area between particles is large and redispersion is not possible, even if the cleaning liquid is used.

As described above, this shows that, if the particle size ratio is large, then the fine particles become embedded in between the large particles, a high-density aggregate is formed and therefore the redispersibility with respect to the cleaning liquid is reduced. In an ink set having a large particle size ratio, satisfactory redispersion by the cleaning liquid can not be obtained.

Furthermore, for each of the inks determined to have satisfactory cleaning properties, the average particle size of all of the materials was 50 nm or above, and it was seen that the content of fine particles has an adverse effect on cleaning properties.

With regard to particle size, the smaller the particle size, the greater the particle density, even if the material is added to the ink at the same concentration by weight, and therefore the frequency of particle collisions increases. Furthermore, it is also known that the probability of aggregation after increase is higher, the smaller the particle size. From the results described above, as the particle size becomes smaller, the aggregation speed becomes higher, the probability of forming a high-density aggregate rises, and redispersion after aggregation becomes more difficult.

The glass transition temperatures of the latexes used in the examples are as follows: the acrylic latex of average particle size 30 nm (Jurymer ET-410): 45° C.; the styrene acrylic latex of average particle size 57 nm (Joncryl 537): 49° C.; the styrene acrylic latex of average particle size 89 nm (Joncryl 7640): 85° C.; and the ethylene acrylic latex of average particle size 8.7 nm (Zaikthene L): lower than 10° C. A necessary requisite was a glass transition temperature of the particles of 45° C. or higher.

The glass transition temperature can be considered as the temperature at which the surfaces of the particles respectively fuse together. Since particles that have fused together are bonded to each other by a chemical bonding force, then it is difficult to achieve redispersion of these particles. It is a premise of the present invention that the particles are bonded together by intermolecular forces, the object being to achieve redispersion in the cleaning liquid of the particles that are in a state of relatively weak adhesion, on the basis of intermolecular forces. Therefore, in order to prevent the particles from fusing together, it is necessary that the glass transition temperature is higher than room temperature. Taking account of the temperature rise in the apparatus, and variations in the ambient temperature, it is desirable that the glass transition temperature is not lower than 45° C.

In the present description, the upper limit of the particle size ratio is set as Dmax/Dmin≦2.6, where Dmax is the maximum particle size and Dmin is the minimum particle size; and since it is naturally possible that an ink set is composed of only the inks having the same particle size, then the lower limit of Dmax/Dmin≧1.0 is also established. However, it is difficult to form an image by means of particles of the same size only. Desirably, the yellow pigment ink has an average particle size not less than 150 nm, in order to achieve good optical density. On the other hand, it is adequate that the cyan, magenta and black pigment inks have a particle size of 100 nm or lower. Therefore, it is more desirable that the size ratio in the two-liquid reactable particles is Dmax/Dmin≧1.5.

The present invention is not limited to the cleaning of the ejection surface of the recording head 10 (liquid ejection device), and it can also be applied to the cleaning of a paper conveyance unit (for example, conveyance belt), which conveys a recording medium, or an intermediate transfer body in a transfer type of recording apparatus, which forms an image on an intermediate transfer body and then transfers same to a recording medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording method, comprising:

a liquid ejection step of ejecting a plurality of first liquids and a second liquid from different ejection ports of a liquid ejection device, the first liquids each containing solvent-insoluble materials, the second liquid causing the solvent-insoluble materials to form an aggregate; and a cleaning liquid supply step of supplying a cleaning liquid causing the aggregate of the solvent-insoluble materials to redisperse, wherein the liquid set satisfies Dmax/Dmin≦2.6, where Dmax is a maximum of average particle sizes of the solvent-insoluble materials in the first liquids, and Dmin is a minimum of the average particle sizes of the solvent-insoluble materials in the first liquids.

2. The inkjet recording method as defined in claim 1, wherein the average particle sizes of the solvent-insoluble materials in the first liquids are not smaller than 50 nm.

3. The inkjet recording method as defined in claim 1, wherein at least one of the first liquids contains at least one type of latex as the solvent-insoluble material.

4. The inkjet recording method as defined in claim 3, wherein the at least one type of latex has a glass transition temperature not lower than 45° C.

5. The inkjet recording method as defined in claim 1, further comprising a cleaning step of cleaning a surface of the liquid ejection device by means of the cleaning liquid supplied in the cleaning liquid supply step, the ejection ports being opened in the surface.

6. The inkjet recording method as defined in claim 5, wherein the cleaning liquid is an organic solvent containing a nonionic or anionic surfactant.

7. The inkjet recording method as defined in claim 1, wherein the at least one type of latex includes an acrylic latex.

8. The inkjet recording method as defined in claim 1, wherein said second liquid is deionized water.

9. The inkjet recording method as defined in claim 1, wherein said liquid set satisfies Dmax/Dmin≦2.0.

* * * * *